United States Patent [19]

Pendleton et al.

[11] Patent Number: 4,925,245

[45] Date of Patent: May 15, 1990

[54] DEVICE CONVERTIBLE INTO A CHAIR, TABLE, BED OR STOOL

[76] Inventors: John H. Pendleton, P.O. Box 888 99893-131-G-Unit; James Gabriel, P.O. Box 888 02858-068-E-Unit, both of Ashland, Ky. 41101

[21] Appl. No.: 321,418

[22] Filed: Mar. 9, 1989

[51] Int. Cl.[5] ..... A47C 7/00

[52] U.S. Cl. ..... 297/440; 297/111; 297/192

[58] Field of Search ..... 297/122, 440, 108, 111, 297/357, 192

[56] References Cited

U.S. PATENT DOCUMENTS

| | | | |
|---|---|---|---|
| 735,313 | 8/1903 | Stubbs | 297/357 |
| 759,897 | 5/1904 | Lindgren | 297/192 |
| 794,461 | 7/1905 | Mackey | 297/192 |
| 893,095 | 7/1908 | Peterson | 297/108 |
| 1,216,172 | 2/1917 | Schulz | 297/111 |
| 1,249,415 | 12/1917 | Kantor | 297/192 |
| 1,566,664 | 12/1925 | Freakes | 297/192 |
| 3,128,123 | 4/1964 | Schreier | 297/440 |
| 3,672,723 | 6/1972 | Decursu et al. | 297/440 |
| 3,989,300 | 11/1976 | Heumann | 297/440 |
| 4,473,254 | 9/1984 | Secon | 297/111 |

*Primary Examiner*—Francis K. Zugel

*Attorney, Agent, or Firm*—Browdy and Neimark

[57] ABSTRACT

A device, include at least two stackable frames, can be converted from a chair into a flatbed, stool or table. The top frame provides a housing for telescoping legs or a telescoping plate and includes vertical and horizontal openings for removably receiving a backrest in a horizontal or vertical orientation. A seat plate, which can support a seat, is attached to and within the first frame. When the telescoping legs or plate are extended forward, the device can be converted from a chair into a flatbed or table by moving the seat to the base formed by the telescoping legs and attaching the backrest horizontally to the first frame. A third frame can be stacked between the first and second frames and the second and third frames can house drawers. The present invention is particularly useful in service station garages. The bottom of the second frame has rollers attached for mobility.

20 Claims, 10 Drawing Sheets

DEVICE CONVERTIBLE INTO A CHAIR, TABLE, BED OR STOOL

BACKGROUND OF THE INVENTION a. Field of the Invention

The present invention relates generally weight supporting devices, and more particularly to such devices which are convertible into a variety of different positions.

b. Description of the Prior Art

Convertible weight supporting devices capable of supporting a person are well-known. These devices include sofa beds and lounge chairs. Usually, however, the mechanisms which these devices rely upon for convertibility weaken the structure, so that the device is not capable of rugged use, for example, in a service station or garage which repairs automobiles, motorcycles and/or trucks.

Service stations and garages require flatbeds, chairs with back support, tables, stools and storage means for tools. Generally, flatbeds, tables, chairs and stools have been provided separately. Tools and discarded parts have been placed on the floor, where they could be lost, damaged, or present a hazard to persons in the work area.

Also, a variety of power tools may be used in a garage, and the resulting number of extension cords on the floor creates a hazard and reduces mobility.

SUMMARY OF THE INVENTION

It is an object of the present invention to provide a device which can reduce or eliminate the above-noted drawbacks of the prior art.

It is another object of the present invention to provide a rugged device, usable in a service station garage, which can be converted from a chair shape into a stool, table and flatbed.

It is a further object of the present invention to provide a device which can be adapted to provide a variable amount of storage space.

These and other objects are achieved by the present invention. A top frame, with telescoping legs, or a telescoping plate, may be detachably stacked upon a second frame. The top frame has a seat plate attached within. A seat can be supported by and within the first frame. When the telescoping plate or legs are extended forward they provide a base for the seat, so that the device can be converted into a flatbed or a table. The back of the first frame also includes means for removably receiving a backrest in either a vertical or horizontal orientation. If desired, a third frame may be detachably stacked between the first and second frames. Further, the second and third frames may include storage means therein, and the second frame and/or third frame can include a wire mesh-bottomed tray extending outside thereof for receiving wet and/or oily tools and parts. Additionally, each frame unit may include wiring and one or more electrical outlets, so that electric tools may be plugged into the device, increasing the mobility thereof. Preferably, the second frame has rolling means, such as wheels or rollers, attached to its underside, so that the chair may be rolled to a convenient location.

BRIEF DESCRIPTION OF THE FIGURES

The present invention will be better understood by reference to the Figures described below, wherein like numbers refer to like structures.

DESCRIPTION OF THE PREFERRED EMBODIMENTS

Figure 1:
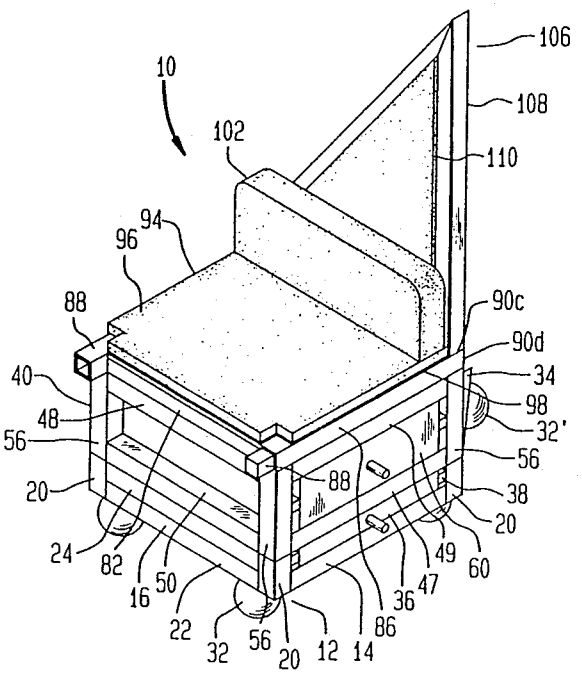
FIG. 1 is a plan view of the chair form of a preferred embodiment according to the present invention.
Figure 3:
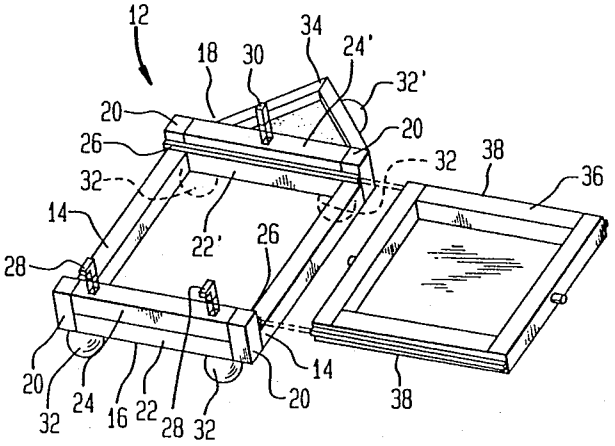
FIG. 3 is a partially exploded angled top view of the bottom frame, with attached tool tray and the drawer that fits in the frame.
Figure 2:
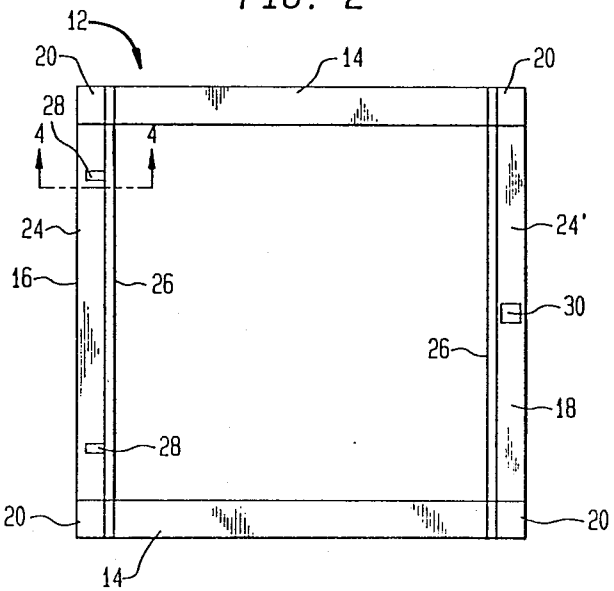
FIG. 2 is a top view of the bottom frame of the present invention.

FIG. 1 illustrates a preferred embodiment of the present invention, 10, in its fully assembled upright chair position. A bottom frame 12 includes opposing side members 14 (only one of which is visible in FIG. 1), front member 16, and opposing back member 18 (FIG. 2). The front 16, back 18, and side 14 members join vertical legs 20 at the corners of frame 12. Each front 16 and back 18 member is made of two bars 22, 22′ and 24, 24′, the upper bars 24, 24′ having drawer guides 26 attached on the inside surfaces thereof (FIG. 2). The drawer guides 26 are preferably attached to the inside surfaces of legs 20 as well. As shown in FIG. 3, retainer clips 28 are positioned on top of upper bar 24 of front member 16 and are L-shaped pieces. A pin 30 extends upward from upper bar 24′ of back member 18. Four rollers 32 are attached to the bottom of frame 12. Tray 34, having a wire mesh bottom for holding tools, is attached to lower back bar 22'. Tray 34 is supported by roller 32' attached to the bottom thereof.

Figure 4:
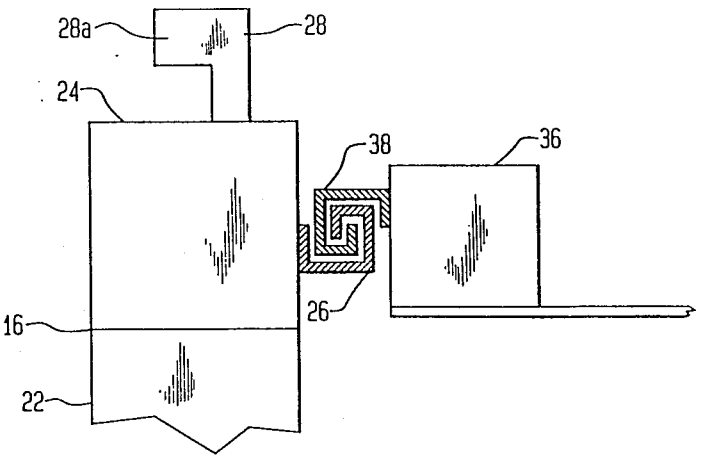
FIG. 4 is a cross-sectional view taken along line 4—4 in FIG. 2.

As best shown in FIG. 3, drawer 36 can slide into the sides of frame 12, above side members 14. Guide members 38 on drawer 36 are slidably received in drawer guides 26 in the manner illustrated in FIG. 4.

Figure 5:
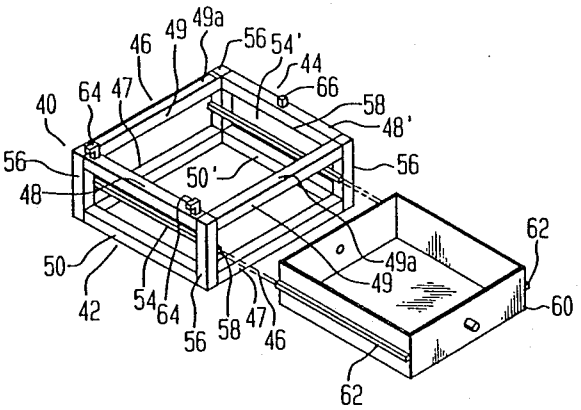
FIG. 5 is a partially exploded angled top view of the middle frame of the invention and the drawer that fits therein.

As best shown in FIG. 5, frame 40 has front member 42, back member 44, and side members 46. Front and back members 42 and 44, include, respectively, upper bars 48, 48', lower members 50, 50' and side panels 54, 54'. Vertical legs 56 are provided at the corners formed by the intersection of the front, back and side members. Drawer guides 58 extend along the inside surfaces of side panels 54, 54' and vertical legs 56 and are of similar construction to drawer guides 26. Drawer 60, having guide members 62 attached to the sides thereof, slides into either side of frame 40. Guide members 62 and drawer guides 58 cooperate with each other in a manner analogous to that illustrated in FIG. 4 for guide members 38 and drawer guides 26.

Upper bar 48 has two retainer clips 64 analogous in position, structure and function to retainer clips 28. Upper bar 48' has a pin 66 extending upwardly therefrom analogous in position, structure and function to that of pin 30.

Side members 46 each have lower bars 47 and upper bars 49. The top surface of upper bars 49 have rubber pads 49*a* attached thereto.

Figure 7:
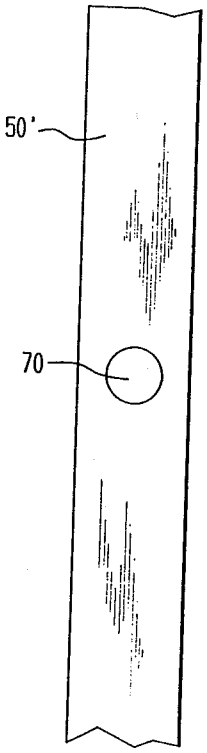
FIGS. 6 and 7 illustrate the means for removably joining frames to each other, using the attachment of the middle frame to the base frame as an example, and is viewed from the bottom side along the plane where the two frames intersect.
Figure 6:
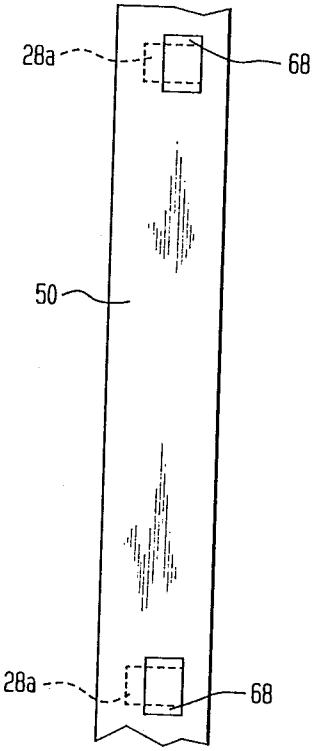

As shown in FIG. 6, lower bar 50 has, on its bottom surface, openings 68 positioned and adapted to receive the overhanging edges 28*a* of retainer clips 28 in the manner shown in dash dot form in FIG. 6. The illustrated positioning of overhanging edges 28*a* in openings 68 can be accomplished by positioning frame 40 with front member 42 tilted downward over and slightly forward of front member 16, with overhanging edges 28*a* laterally aligned with openings 68. Frame 40 is then moved rearward so that overhanging edges 28*a* fit into openings 68. Then, back member 44 of frame 40 is rotated downward so that pin 30 is received in opening 70 on the bottom surface of lower back member 50' (FIG. 7). The above procedure can be reversed to remove frame 40 from frame 12.

Figure 8B:
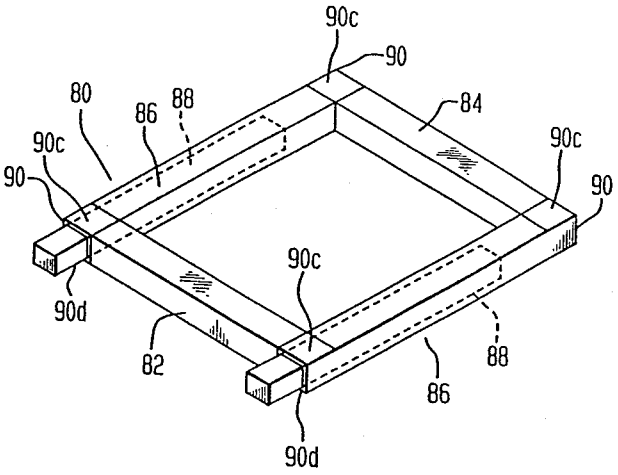
FIGS. 8*a* and 8*b* show the structure of the top frame of the present invention, as viewed from the top at an angle, with the seat plate removed.
Figure 8A:
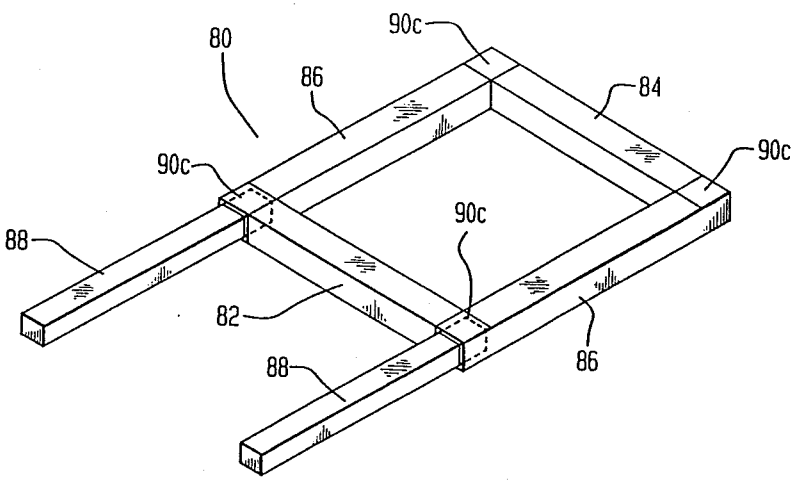

As shown in FIG. 8*a*, frame 80 has front and rear members 82, 84, respectively, and side members 86. Each side member 86 houses a telescoping leg 88 shown in fully extended position in FIG. 8*a* and in retracted position in FIG. 8*b*.

Figure 9:
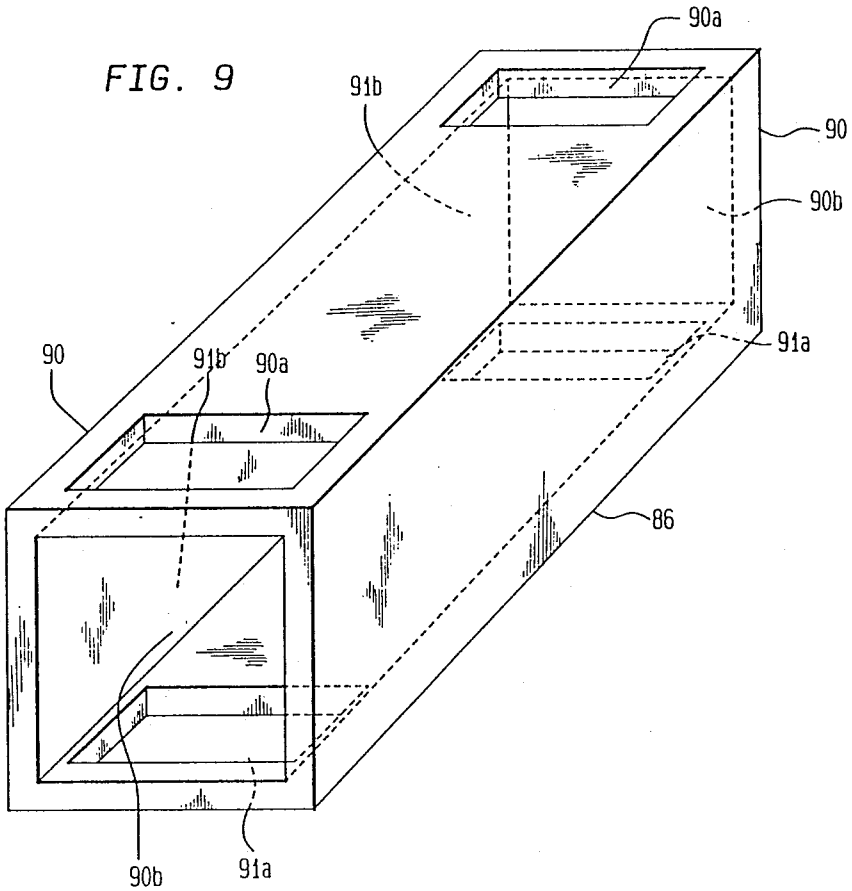
FIG. 9 illustrates the structure of the side members of the top frame.

As best shown in FIG. 9, side members 86 are hollow and define boxes 90 at the corners where front and rear members, 82, 84, respectively, intersect side members 86. Boxes 90 have two adjoining cut-out faces, 90*a* and 90*b*, which, when assembled within frame 80 provide vertical and horizontal openings, 90*c* and 90*d*, respectively. The face of box 90 opposing faces 90*a* and 90*b* also has cut-out 91*a* and hollow 91*b*. When extended, telescoping legs 88 extend forward through cut-out 90*d* and hollow 91*b* at the front end of frame 80.

Figure 10:
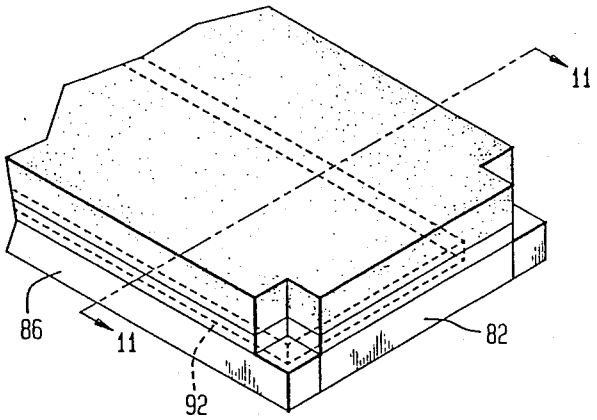
FIG. 10 is a plan view of the seat and top frame of the present invention.
Figure 11:
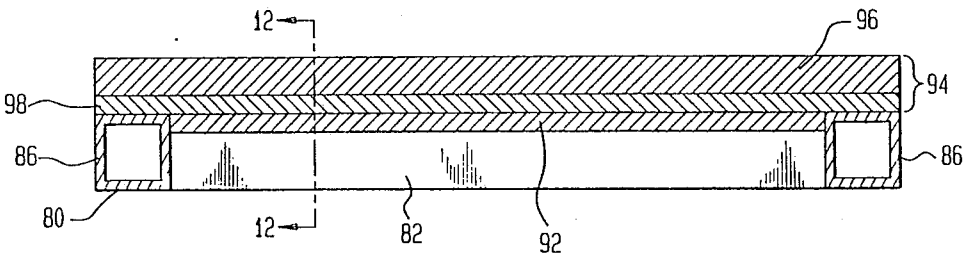
FIG. 11 is a cross-sectional view taken along line 11—11 of FIG. 10.
Figure 12:
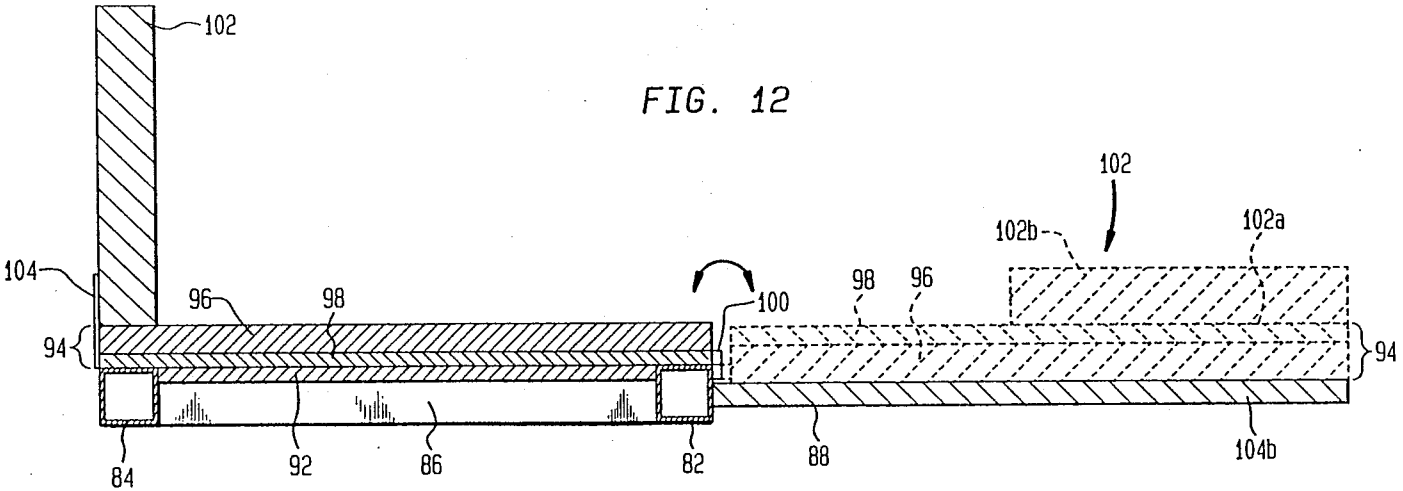
FIG. 12 is a cross-sectional view taken along line 12—12 of FIG. 11.

As shown in FIGS. 10 and 11, a seat plate 92 is fixed by suitable means (rivets, welding, etc.) within frame 80 to define a flat upper surface therein. A seat 94, which includes a cushion 96 fixed to a cushion plate 98 made of steel or other strong and rigid material, is removably supported by frame 80 (including seat plate 92). The seat 94 can be supported on frame 80 by friction and gravity, without other means for attachment (as shown in FIG. 10) or can be fixed by hinge 100 to a forward face 82*a* of front member 82 (as shown in FIG. 12). Seat 94 can be rotated about the center of hinge 100 as indicated by the arrows to convert seat 94 from the folded form (solid lines) to the unfolded form (dotted lines). In its unfolded position, seat 94 is supported upon telescoping legs 88, the cushion plate 98 being on the top and cushion 96 facing and resting upon telescoping legs 88.

Figure 13:
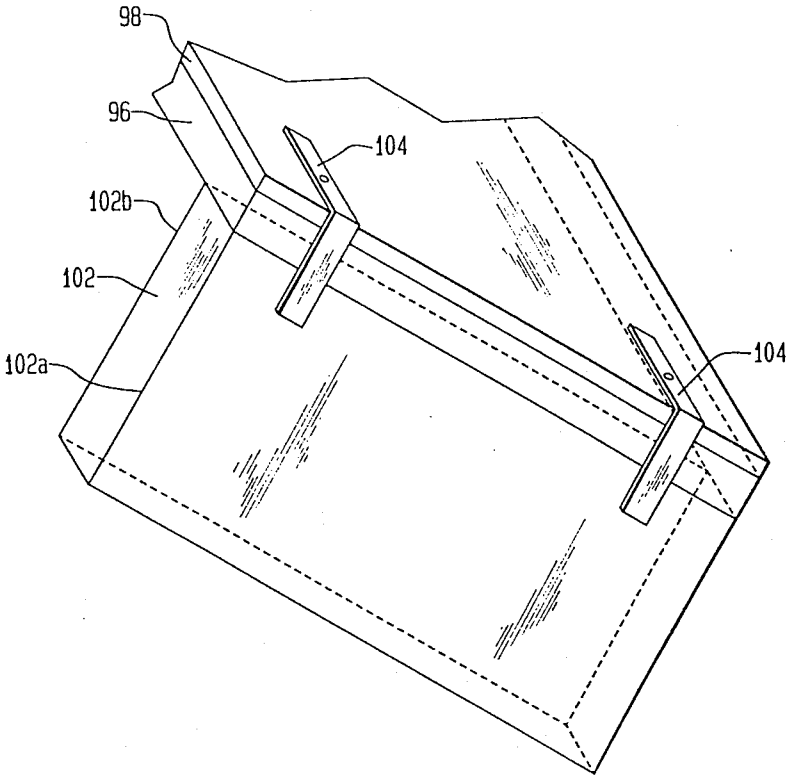
FIG. 13 is a plan view of the seat, taken from the bottom of the seat, with the headrest attached.

If desired, cushioned piece 102 can be removably attached by button or snap to the back end of cushion plate 98 with strap 104 (FIG. 13) and used as a back support when seat 94 is folded (solid lines) or as a head rest when seat 94 is unfolded (dotted lines). Strap 104 is made of a flexible material and is sewn or otherwise attached to back side 102*a* of piece 102. When piece 102 is used as a headrest, as shown in FIG. 12, strap 104 can be tucked between cushion plate 98 and surface 102*a*, while surface 102*b* faces up.

Front and back members 82 and 84, respectively, have bottommost surfaces essentially identical to those of front members 46, 42 and back members 18, 44 (see FIGS. 6 and 7) so that frames 40 and 80 are interchangeable and removably stackable upon frame 12 and so that frame 80 can also be removably stacked upon frame 40.

Figure 14:
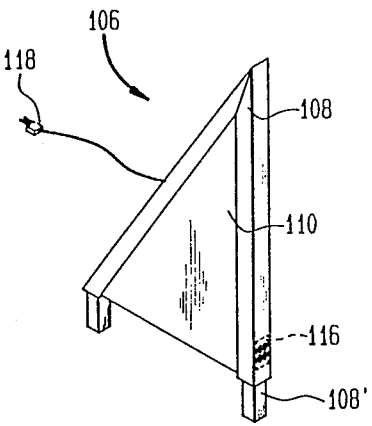
FIG. 14 is a plan view of the backrest of the present invention.
Figure 14A:
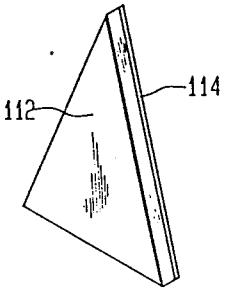
FIG. 14*a* is a plan view of the cushion of the backrest shown in FIG. 14.

As shown in FIG. 14, backrest 106 includes backrest frame 108, with legs 108' being slidably insertable with vertical openings 90*c* or horizontal openings 90*d* at the back end of frame 80. Backrest pad 110 is fixed within backrest frame 108. As illustrated in FIG. 14*a*, backrest pad 110 has a structure analogous to that of seat 94, with cushion 112 supported by cushion plate 114.

In order to minimize the weight of the device 10, the frame member, including vertical legs 20, should preferably, to the extent practical, be hollow. In addition to minimizing weight, the use of hollow frame members permits the chair to be internally wired, so that one or more electrical outlets 116 may be provided on any frame thereof (FIG. 14). Each frame member may be connected to a power source (not shown) via an electrical cord 118 (FIG. 14) also attached, removably or permanently, to that frame or a frame electrically connected thereto. If desired, each frame can be internally wired and have electrical contacts (not shown) permitting electrical communication between each stacked frame. For example, the pins provided on the frame back members could also serve as properly insulated electrical contacts between frames. In that embodiment, the power cord is preferably attached to the bottom frame. The provision of outlets 116 and cord 118 permit a variety of power tools (not shown) to be connected to the power source through the device 10, thus reducing clutter.

In FIG. 1, the device 10 is in the full chair position. Telescoping legs 88 are retracted, frame 40 is stacked atop frame 12, and frame 80 is stacked atop frame 40. The seat 94 is folded and piece 102 is vertically oriented. Frame 108, with cushion 110, of backrest 106, is inserted within vertical openings 90*d* in the back of frame 80.

Figure 15:
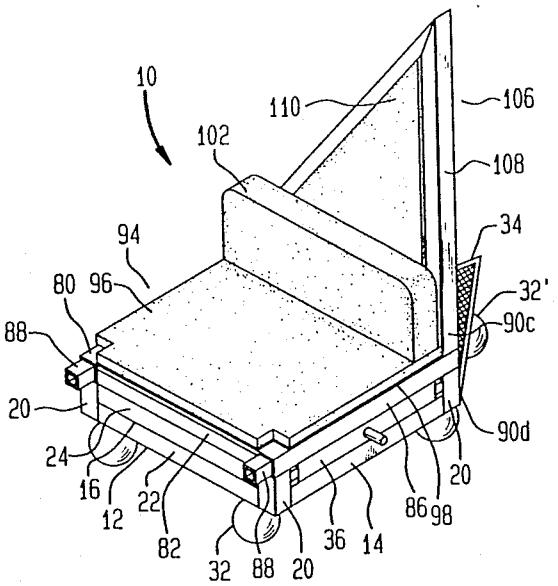
FIG. 15 shows the present invention, in the chair position, with the frame removed.

In FIG. 15, device 10 is in a position similar to that shown in FIG. 14, except that frame 40 has been removed and frame 80 is stacked directly atop frame 12.

Figure 16:
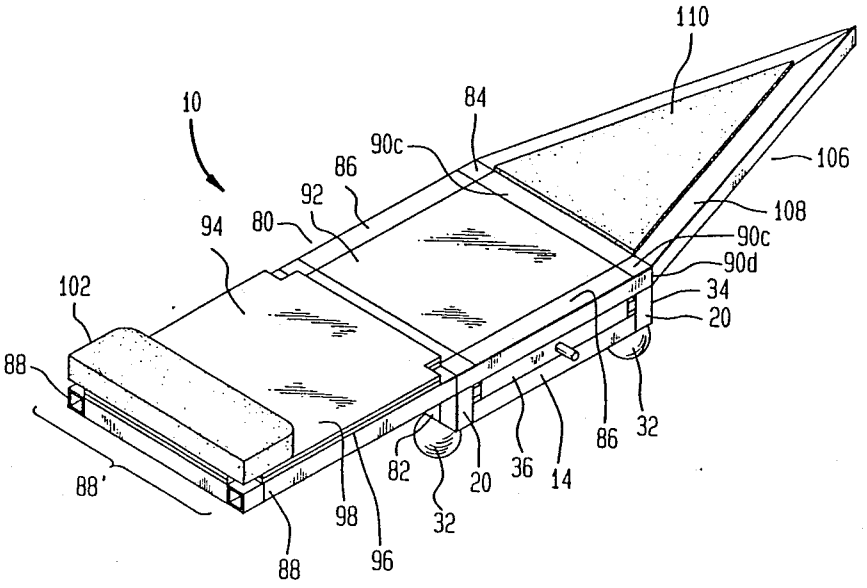
FIG. 16 shows the present invention, in the flatbed position, with the frame removed.

In FIG. 16, device 10 is in a flat "bed" position. To achieve the position shown in FIG. 16, a person can start with the arrangement shown in FIGS. 14 or 15. If starting with the arrangement of FIG. 14, frame 40 must be removed and frame 80 stacked directly atop frame 12. Telescoping legs 88 are extended and seat 94 is unfolded to be supported by base 88' formed by the extended telescoping legs. Backrest 108 is removed from vertical openings 90*c* in the back of frame 80 and inserted into horizontal openings 90d. Piece 102 is moved to a horizontal position.

Figure 17:
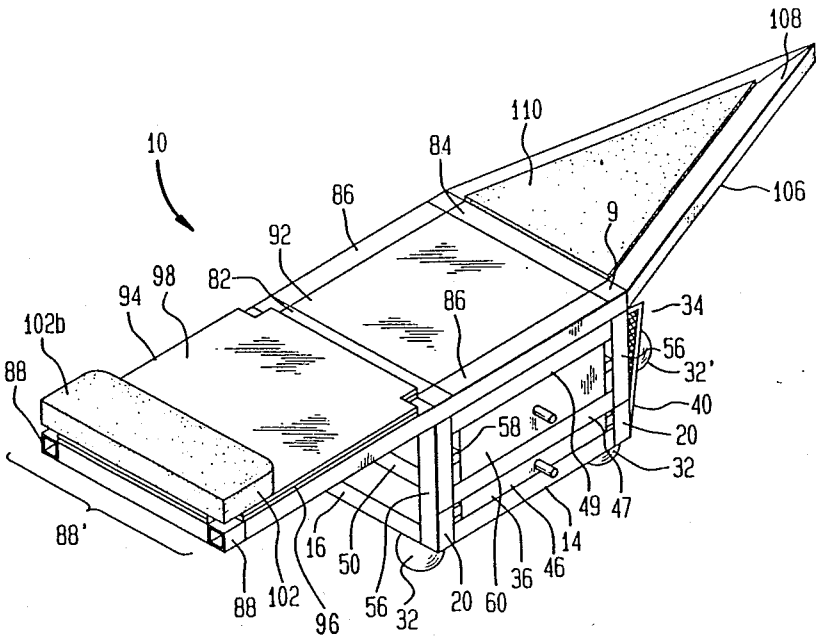
FIG. 17 shows the present invention, in the table position, with the middle frame in place.

In FIG. 17, the device 10 is in a table position. This position is essentially the same as that shown in FIG. 16, but in FIG. 17, frame 40 has been stacked between frames 12 and 80.

If the backrest and piece 102 of the chair shown in FIG. 1 or FIG. 15 is removed, the device 10 becomes a stool.

Figure 18:
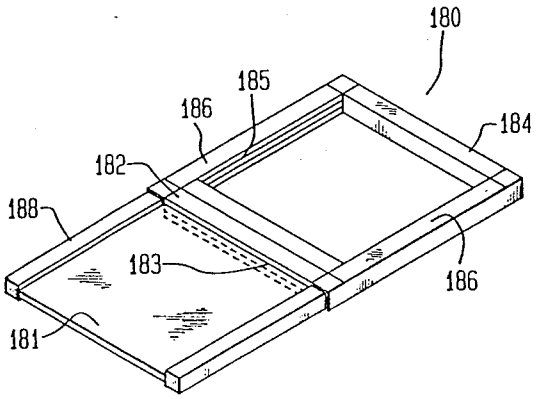
FIG. 18 is a plan view of a top frame, with the seat plate removed, of another embodiment according to the present invention.

In an alternative embodiment, telescoping legs 88 defining the base can be augmented or replaced by including, in frame 80, telescoping plate 181 which retracts into and can be extended forward of the upper frame. As shown in FIG. 18 telescoping plate 181 can slide, over or under the seat plate, through a slot 183 in front member 182 of frame 180 replacing frame 80. Frame 180 is constructed virtually identically to frame 80 of the prior embodiment, with the exception of the provision of slot 183 in front member 182 and guide rail means 185 on the inside surfaces of side members 186. Rear member 184 may have the same structure as corresponding rear member 84 of frame 80. Telescoping legs 188 are attached to each side of telescoping plate 181 for extension and retraction therewith into frame 180, telescoping legs sliding within hollow side members 186. When a telescoping plate is used, the seat can be a cushion without a cushion plate, since, in each position, the bottom of the cushion will be supported by the telescoping plate 181.

Further details regarding construction of the present invention, including exact dimensions for each part of an exempletive embodiment of the present invention are described in the Disclosure Documents filed in the United States Patent and Trademark Office on Sept. 16th and Oct. 12, 1988 (numbers not yet received), both of which are incorporated herein by reference.

Also, the present invention may be used in a variety of circumstances, including hospitals, doctors' offices, grocery stores, plumbing shops, nursery farms, sewing plants, furniture assembly plants, race tracks, detail shops, ship yards, machine shops, boat and trailer shops, rehabilitation centers, child's nursery, casinos, refrigeration plants, commercial transit (train, bus or plane), hunting and other sports, devices for use by handicapped (especially children), as well as other domestic and commercial uses.

Obviously, many other variations of the present invention can be constructed without departing from the present invention as reflected in the scope of the appended claims.

What I claim is:

1. A convertible weight supporting device, comprising:

a first frame, having a front end and a back end;

telescoping means, extendable forward of said front end, housed within said first frame, said telescoping means, when extended, defining a base;

a second frame, upon which said first frame is removably stackable;

a seat plate attached to and within said first frame and defining a horizontal surface therein;

a seat means, including a cushion, which is removably supportable upon said first frame with a lower surface of said cushion facing said seat plate, and which is also removably supportable upon said base;

a backrest removably connected to said first frame, wherein said back end of said first frame includes vertical receiving means for removably receiving said backrest in an essentially vertical orientation with respect to said first frame, and horizontal receiving means for removably receiving said backrest in an essentially horizontal orientation with respect to said first frame.

2. The device of claim 1, further comprising a third frame removably stackable upon said second frame and upon which said first frame can be removably stacked.

3. The device of claim 1, wherein second frame has a tray attached to and extending outward therefrom.

4. The device of claim 1, wherein said second frame includes a storage means therein.

5. The device of claim 4, wherein said storage means comprises guide means for receiving a drawer.

6. The device of claim 2, wherein said second and third frames each include a storage means therein.

7. The device of claim 5, wherein said storage means comprises a guide means for receiving a drawer.

8. The device of claim 1, wherein said horizontal and vertical receiving means comprise, respectively, horizontal and vertical openings in said back end of said frame member.

9. The device of claim 1, further including rolling means attached to a bottom surface of said second frame.

10. A weight supporting device, capable of supporting a person, a which is convertible into a variety of different positions, comprising:

a first frame, having a first set of opposing front and back members and a first set of opposing side members, said first set of front and back members intersecting said first set of opposing side members to define corners;

a pair of telescoping legs, each leg being slidably housed within said first set of opposing side members for extending frontward, said pair of telescoping legs, when extended, defining a base;

a second frame having a second set of opposing front and back members and opposing side members and having a lateral cross-section of essentially identical size and shape as said first frame and including first retaining means for releasably attaching a frame of essentially identical lateral cross-section on a top surface thereof, said first frame being removably attachable to said top surface of said second frame by said first retaining means;

rolling means attached to a bottom surface of said second frame;

a seat plate fixed within said first frame and defining a horizontal surface therein;

a seat means, including a cushion backed by a cushion plate, which is removably supportable upon said first frame with said cushion plate facing said seat plate, and which is also removably supportable upon said base;

a cushion backrest and backrest receiving means for removably receiving said backrest in a vertical as well as a horizontal orientation at back corners of said first frame.

11. The device of claim 10, further including a third frame having an essentially identical lateral cross-section as said first frame and removably attachable to said top surface of said second frame by said first retaining means, said third frame including second retaining means for releasably attaching said first frame to a top surface thereof.

12. The device of claim 11, further comprising a first drawer and a first guide means in said second frame for slidably receiving said first drawer.

13. The device of claim 12, further comprising a second drawer and a second guide means in said third frame for slidably receiving said second drawer.

14. The device of claim 10, further comprising a cushioned headrest attached to an end of said cushion plate opposite said end where said seat plate is attached thereto, said headrest being capable of extending upward when said seat means is supported upon said first frame and extending horizontally along an exposed surface of said cushion plate when said seat means is supported upon said base.

15. The device of claim 10, further comprising a tray attached to and extending rearward of said second frame.

16. The device of claim 15, wherein said tray has a wire mesh bottom.

17. The device of claim 10, wherein said seat means is hinged to said front member of said first frame.

18. The device of claim 1, further comprising an electrical outlet disposed on at least one of said frames and electrical wiring for said outlet disposed within the at least one of said frames.

19. The device of claim 18, further comprising at least one electrical contact for electrically connecting said frames.

20. The device of claim 10, further comprising an electrical outlet disposed on at least one of said frames and electrical wiring for said outlet disposed within the at least one of said frames.

* * * * *